US010018404B2

(12) United States Patent
Becke et al.

(10) Patent No.: US 10,018,404 B2
(45) **Date of Patent: *Jul. 10, 2018**

(54) REFRIGERATOR HAVING A DOOR

(71) Applicant: BSH HAUSGERAETE GMBH, Munich (DE)

(72) Inventors: Christoph Becke, Grosskarolinenfeld (DE); Max Eicher, Munich (DE); Klaus Foersterling, Amerang (DE); Christine Hartwein, Nandlstadt (DE); Andreas Kessler, Munich (DE); Philipp Kleinlein, Munich (DE); Ralph Staud, Munich (DE); Thomas Tischer, Haar (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/327,088

(22) PCT Filed: Jul. 16, 2015

(86) PCT No.: PCT/IB2015/055388

§ 371 (c)(1),
(2) Date: Jan. 18, 2017

(87) PCT Pub. No.: WO2016/009382

PCT Pub. Date: Jan. 21, 2016

(65) Prior Publication Data

US 2017/0184336 A1 Jun. 29, 2017

(30) Foreign Application Priority Data

Jul. 18, 2014 (CN) ..... 2014 1 0344403

(51) Int. Cl.
*A47B 96/04* (2006.01)
*F25D 23/02* (2006.01)

(52) U.S. Cl.
CPC ..... *F25D 23/028* (2013.01); *F25D 2323/021* (2013.01); *F25D 2400/361* (2013.01)

(58) Field of Classification Search
CPC ..... F25D 23/028
(Continued)

(56) References Cited

U.S. PATENT DOCUMENTS 8,714,673 B2 * 5/2014 Kim ..... F25D 23/02 312/405
2009/0289536 A1 * 11/2009 Park ..... F25D 23/028 312/405

(Continued)

FOREIGN PATENT DOCUMENTS

CN 2699206 Y 5/2005
DE 102012200812 A1 7/2013

(Continued)

*Primary Examiner* — Matthew W Ing
(74) *Attorney, Agent, or Firm* — Laurence A. Greenberg; Werner H. Stemer; Ralph E. Locher

(57) ABSTRACT

A refrigerator includes a door having a user interface electrical module, an accommodating space accommodating the user interface electrical module, a handle groove, and a concave portion being open towards a front surface and a side surface of the door in such a way that the handle groove is accessible to a user through the concave portion. The door includes a user interface housing. The accommodating space, the handle groove and the concave portion are located within the user interface housing and are successively disposed side by side along a depth direction of the handle groove.

15 Claims, 9 Drawing Sheets

(58) Field of Classification Search
USPC ..... 312/7.2, 401, 405, 405.1, 408
See application file for complete search history.

(56) References Cited

U.S. PATENT DOCUMENTS

| | | | | |
|---|---|---|---|---|
| 2012/0326587 | A1 | 12/2012 | Jeong et al. | |
| 2014/0246970 | A1* | 9/2014 | Park | F25D 23/028 312/404 |
| 2015/0052920 | A1* | 2/2015 | Park | F25D 29/005 62/126 |
| 2015/0292793 | A1* | 10/2015 | Bischoff | F25D 23/028 312/404 |
| 2015/0308158 | A1* | 10/2015 | Jeon | 312/405 |

FOREIGN PATENT DOCUMENTS

| | | | |
|---|---|---|---|
| EP | 2538160 | A2 | 12/2012 |
| JP | 2013178054 | A | 9/2013 |

* cited by examiner

REFRIGERATOR HAVING A DOOR

BACKGROUND

Technical Field

The present invention relates to a refrigerator, and in particular, to a household refrigerator having a door.

Related Art

CN2699206Y discloses a refrigerator door. The refrigerator door includes a front wall, a door inner plate and a door cover. The front wall, the door inner plate and the door cover are combined together through a heat insulation foaming layer filled between the front wall and the door inner plate. The front wall has an edge opening, and the edge opening is sealed by the door cover. The door cover has a concave portion that dents towards the heat insulation layer. A detachable decoration panel is installed onto the door, and a rear side of the decoration panel has an accommodating space. The decoration panel and a control and display assembly are pre-assembled to form a pre-assembled unit. The pre-assembled unit is fixed onto the door after a foaming process is performed on the door.

JP 2013-178054A discloses a refrigerator door, including a door body that has a heat insulation layer. A user interface apparatus is disposed in a middle area of the door body as viewed in the longitudinal direction, and located behind a glass plate of the door body. A stepped part that makes the front surface dent is formed on a side surface cover at the right end of the door body. The stepped part seals an accommodating chamber that accommodates the user interface apparatus. A handle member protruding rightward is installed by using a screw on a fitting surface facing towards a side surface of the stepped part. A handle groove extending along the whole height of the door is formed between the handle member and the stepped part. A front surface of the grip portion is covered by a protection cover that is held between a front end of the grip portion and the stepped part. The protection cover is formed by a transparent formed resin part.

SUMMARY

An objective of the present invention is to overcome at least one technical problem in the prior art and provide an improved refrigerator.

The objective can be achieved by characteristics in independent claims. Preferable embodiments of the present invention are the subject of the accompanying drawings, the specification, and dependant claims.

An aspect of the present invention relates to a refrigerator. The refrigerator includes a door, the door including a user interface electrical module that is accommodated in an accommodating space, a handle groove, and a concave portion that is open towards a front surface and a side surface of the door in such a way that the handle groove is accessible to a user via the concave portion, the user interface electrical module, the handle groove and the concave portion being located within a boundary frame in the transverse and longitudinal direction of the door, the boundary frame being open at the side surface, where the concave portion, the handle groove and the user interface electrical module are successively disposed side by side along a depth direction of the handle groove.

As the user interface electrical module, the handle groove and the concave portion are located within a boundary frame extending inward from a side surface of the door, handle-related elements may be integrated with a user electrical interface of the refrigerator. As a result, an operating function of the refrigerator may be visibly integrated in a specified portion of the door. Further, as the concave portion, the handle groove and the user interface electrical module are successively disposed side by side along a depth direction of the handle groove, and may not overlap in the length direction of the handle groove, all of them can obtain a greater length within the boundary frame when demanded. Thus, in addition to the door having a compact operation center, the concave portion and the handle groove may have a sufficiently large length so that a user can conveniently put the hand into the handle groove and grasp the grip portion to open the door. Similarly, the user electrical interface of the user operation center can also occupy a greater size of the door.

It should be understood that, the present invention can apply to various refrigerators with different structures, and shall not be limited to the preferred embodiments of the present invention that are disclosed. For example, the present invention may apply to a side-by-side combination refrigerator having a first storage compartment and a second storage compartment that are disposed side by side, a refrigerator having a first storage compartment and a second storage compartment that are respectively disposed at the upper and lower part, or a refrigerator having a pair of doors that are configured to close a same storage compartment.

A storage compartment of a refrigerator may be used to store food and/or wine. For example, a refrigerator may have a storage compartment purely used for storing wine.

A storage compartment can be a cooling compartment, e.g. with a temperature within the range of 6 to 8 degrees Celsius, or a freezing compartment, e.g. with a temperature within the range of −15 to −18 degrees Celsius.

The door may be a rotatable door pivotally connected to a refrigerator body, or a drawer-type door connected to the body in a push-and-pull manner.

The door may close one or more storage compartments of a refrigerator, or a portion of one or more storage compartments.

In a possible embodiment, a concave portion may be disposed near a longitudinal side of the door, i.e. a vertical side of the door. In an alternative embodiment, a concave portion is disposed near a horizontal side of the door, for example, at the top or bottom.

When a concave portion and a handle groove are disposed near a longitudinal side of the door, for example, near a left or right side of the door, the depth direction of the handle groove is the transverse direction of the door (also referred to as the width direction); and when the concave portion and the handle groove are disposed near a transverse side of the door, for example, at the top or bottom of the door, the depth direction of the handle groove is the length direction of the door (also referred to as the height direction).

A user interface electrical module may include an input unit configured to receive an instruction input by a user, and/or an output unit configured to display information to a user. The user interface electrical module may be entirely located within an accommodating space, or partly located within the accommodating space and partly outside the accommodating space.

The user interface electrical module may include a touch unit configured to receive a touch instruction from a user. In an alternative embodiment, the user interface electrical module may also receive an instruction from a user through another input apparatus such as a key.

Other independent characteristics or those characteristics that are considered as features of the present invention through combination with other characteristics will be described in the following appended claims.

In a possible embodiment, the boundary frame may include a pair of first boundaries that are disposed opposite to each other in parallel and a second edge connecting the pair of first boundaries, where the first boundaries are connected to the side surface, and the second edge has a distance from the side surface.

In a possible embodiment, at least one of the first boundaries and the second edge may be formed by a connection gap between a first part and a second part of the door. Thus, the boundary frame may be formed only through a functional structure of the door, without setting additional indication apparatus.

In a possible embodiment, at least one of the first boundaries and the second edge may include a printed ribbon on the front surface. In such a manner, the boundary frame may be formed on a continuous front surface of the door. For example, the boundary frame may be formed on a plate manufactured from glass or a material similar to glass in appearance.

In a possible embodiment, when the boundary frame extends from a longitudinal side wall of the door towards another longitudinal side wall of the door, the first edge may extend horizontally along the door. Otherwise, when the boundary frame extends from a transverse side wall of the door towards another transverse side wall of the door, the first edge may extend vertically along the door.

In a possible embodiment, the length of the concave portion may be equal to or slightly less than the length of the boundary frame. As a result, the handle groove and the concave portion may extend along the whole length of the boundary frame, or has a length slightly less than but very close to the length of the boundary frame. Thus, the handle groove and the concave portion may have a maximized length within the boundary frame. The boundary frame may be designed on basis of requirements for the length of the handle groove and concave portion.

In a possible embodiment, the door includes a door body, where the door body may include a door inner liner, a front wall located in front of the door inner liner and having a first opening, and a user interface housing; the user interface housing closes the first opening relative to a thermal insulation space located between the door inner liner and the front wall; and the accommodating space, the handle groove and concave portion are located within the user interface housing.

As functions of the handle and user electrical interface are implemented by using a shared housing as a carrier, the number of components of a pre-assembled unit used in a foaming process of a heat insulation layer of the door may be reduced, thereby better preventing leakage of a foaming liquid from the pre-assembled foaming unit.

The front wall is located in front of the door inner liner. In a possible embodiment, the front wall may form at least a majority part of the front surface of the door, that is, the front wall is exposed outside. In another possible embodiment, the door may further include a decoration panel located in front of the front wall. Such a decoration panel may be manufactured from, for example, glass or a material similar to glass.

In a possible embodiment, the front wall may be formed by a single component. For example, the front wall may be formed by a piece of sheet metal. In another possible embodiment, the front wall may also be formed by a plurality of components, and the components may entirely or partly form a corresponding part of the front wall. In the latter case, the first opening consists of openings that are formed on different components.

In a possible embodiment, the boundary frame may be substantially defined by the first opening. The boundary frame may be located within the first opening, without using another indication apparatus to form a boundary frame.

In a possible embodiment, the user interface housing may be connected to the front wall and a side wall, where the side wall has a second opening that is in communication with the first opening, and the user interface housing closes the second opening relative to the thermal insulation space. As the concave portion may approach through the front opening, the second opening connected to the first opening, a stepped portion needs not to be formed on the side wall for supporting the handle groove. Therefore, the side wall may have a simplified structure. Thus, it may provide a possibility, that is, the side wall may even be integrated with the front wall as a whole. For example, the front wall and the side wall may be formed by a piece of sheet metal, or the side wall may be formed by means of extrusion, even if the handle groove does not extend along the whole height/width of the door.

The front wall and the side wall may be manufactured separately and then assembled together. In an alternative embodiment, the front wall and the side wall may also be formed by different portions of a single component.

In a possible embodiment, the side wall is a longitudinal side wall of the door, such as a left wall or right wall. In another possible embodiment, the side wall may also be a transverse side wall of the door, such as a top wall or bottom wall.

Another aspect of the present invention relates to a refrigerator. The refrigerator includes a door, the door including a user interface electrical module, an accommodating space that accommodates the user interface electrical module, a handle groove, and a concave portion that is open towards a front surface and a side surface of the door in such a way that the handle groove is accessible to a user via the concave portion, where the door includes a user interface housing, and the accommodating space, the handle groove and the concave portion are located within the user interface housing and successively disposed side by side along a depth direction of the handle groove.

Thus, in addition to the door having a compact operation center, the concave portion and the handle groove may have a sufficiently large length so that a user can conveniently put the hand into the handle groove and grasp the grip portion to open the door.

In a possible embodiment, a user interface housing may be fixed to a heat insulation layer of a door.

In a possible embodiment, the door may include a door body, where the door body includes a door inner liner, a front wall located in front of the door inner liner and having a first opening, and a side wall having a second opening; and the user interface housing is connected to the front wall and the side wall, and closes the first opening and the second opening relative to a thermal insulation space filled with a heat insulation layer.

In a possible embodiment, the door may include a front panel covering the user interface electrical module, where the handle groove is located behind the front panel. The front panel is of a one-piece structure.

In a possible embodiment, the door may include a grip portion, the grip portion being located between the front panel and the handle groove in the front-back direction.

In a possible embodiment, the front panel may form at least a majority part of a front surface of the door, and an edge of the front panel has an edge opening to expose the concave portion. It is particularly favorable to a door having a continuous front surface.

In a possible embodiment, the front panel may be detachably fixed to the user interface housing.

In a possible embodiment, the accommodating space may have an entrance that is open towards a side of the handle groove, where the entrance is closed by a handle member that is detachably connected to the door.

In a possible embodiment, the length of the concave portion may be equal to or slightly less than the length of the first opening.

In a possible embodiment, the front panel may include a front panel portion that covers the user interface electrical module and the grip portion in the front-back direction, and a side panel portion that is connected to a side of the front panel portion and extends backward, where the side panel portion covers at least a part of the grip portion along a depth direction of the handle groove.

In a possible embodiment, the user interface housing may include a rear wall, the rear wall restricting a rear edge of the handle groove and the concave portion.

In a possible embodiment, the refrigerator further comprises another door that is disposed with the door side by side, wherein the another door has a second concave portion opposite to the concave portion and a second handle groove.

The structure of the present invention and other inventive objectives and beneficial effects of the present invention become more comprehensible through the description of preferred embodiments with reference to the accompanying drawings.

BRIEF DESCRIPTION OF THE DRAWINGS

As a part of this specification and for further understanding of the present invention, the following accompanying drawings describe specific implementation manners of the present invention, and are used to describe the principle of the present invention together with the specification.

DETAILED DESCRIPTION

Figure 1:
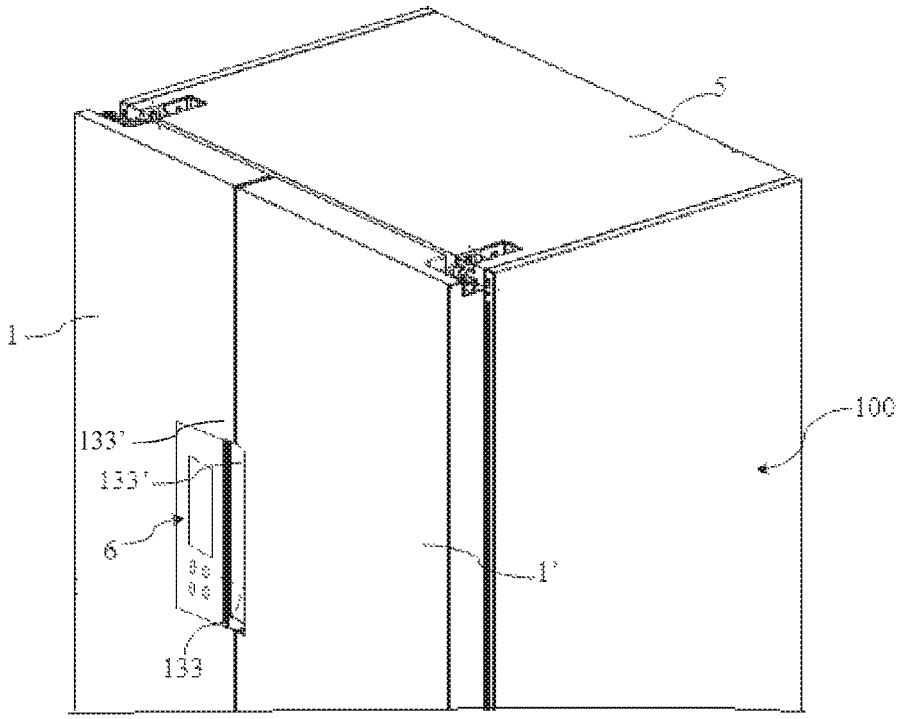
FIG. 1 is a schematic three-dimensional view of a part of a refrigerator according to a preferred embodiment of the present invention.

FIG. 1 is a schematic three-dimensional view of a refrigerator 100 according to a preferred embodiment of the present invention. As shown in FIG. 1, the refrigerator 100 includes a body 5 having a first storage compartment (not shown in the figure) and a second storage compartment (not shown in the figure) that are disposed side by side. The refrigerator 100 further includes a pair of side-by-side doors 1 and 1' that are connected to the body 5, and respectively used for closing a corresponding storage compartment.

Figure 2:
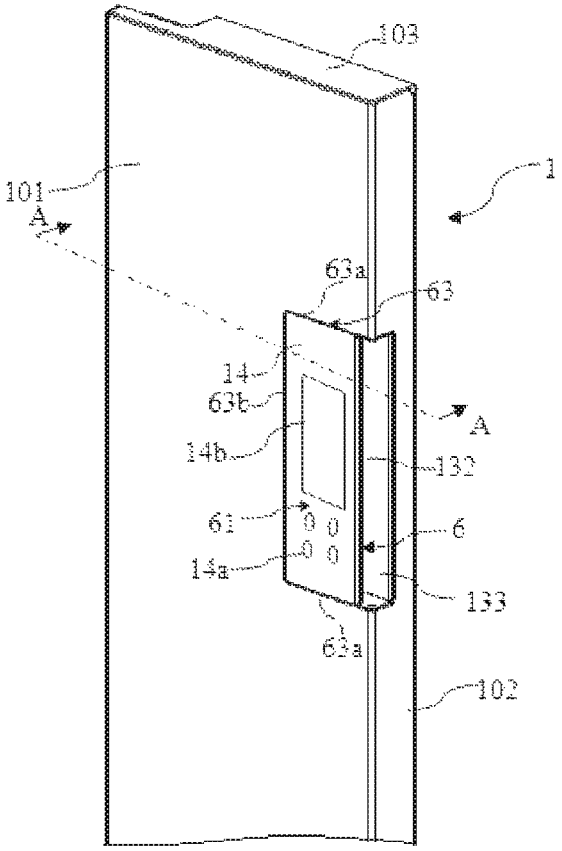
FIG. 2 is a schematic three-dimensional view of a part of a door according to a preferred embodiment of the present invention.
Figure 3:
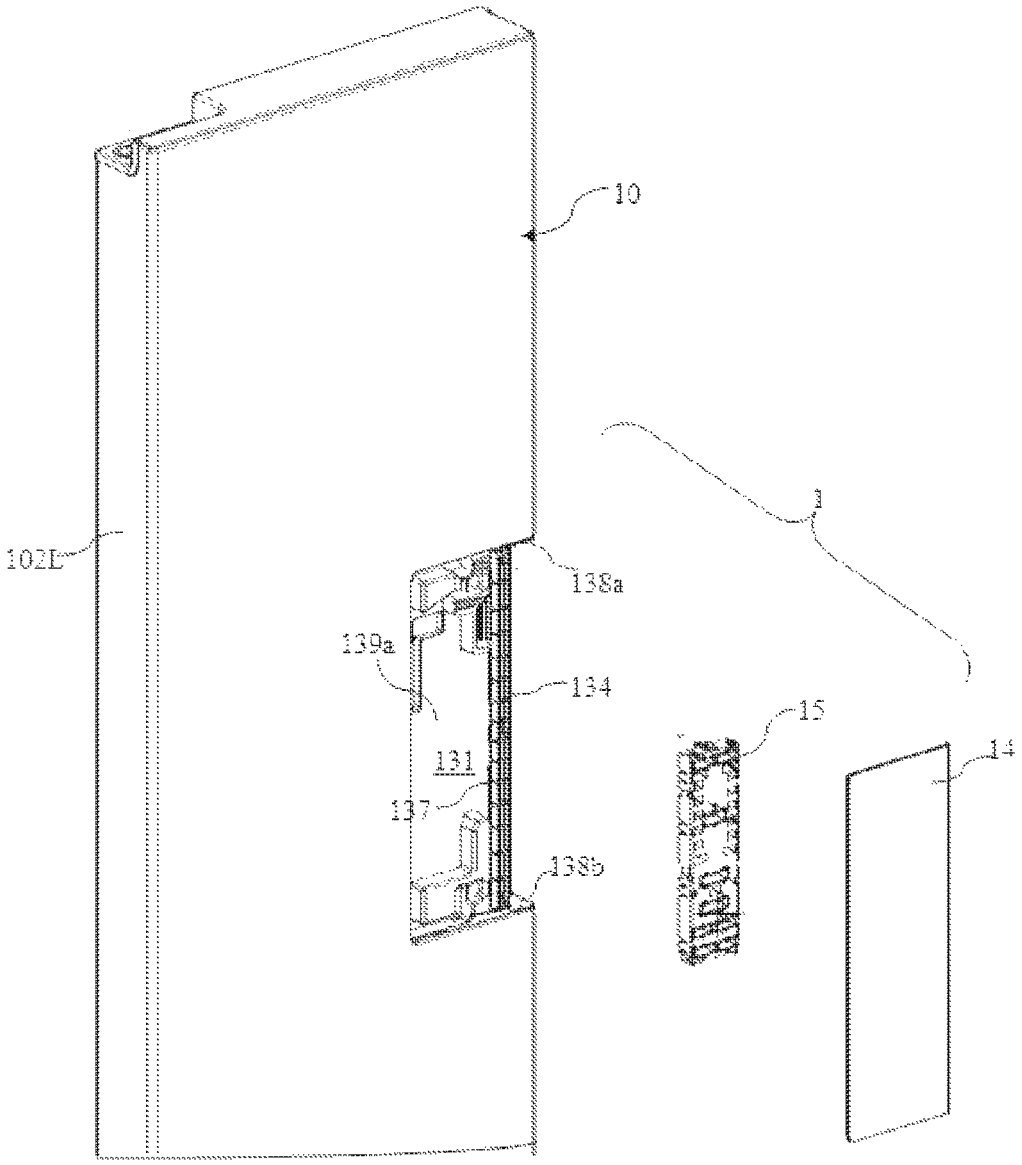
FIG. 3 is a schematic exploded view of a part of a door according to a preferred embodiment of the present invention.

Referring to FIG. 2 and FIG. 3 together with FIG. 1, the door 1 has an integrated operation center 6. The operation center 6 includes a user interface 61 and a handle groove 132 integrated into the operation center 6. When opening or closing the door 1, a user can put the hand into the handle groove 132.

The operation center 6 further includes a concave portion 133 so that a user can put the hand into the handle groove 132 through the concave portion 133. The concave portion 133 is exposed at a front side and a right side of the door 1, and may be approached from the front side and the right side of the door 1.

The operation center 6 is disposed at a side of the door 1 opposite to the another door 1'. In this embodiment, the door 1' has a second concave portion 133' opposite to the concave portion 133, and a second handle groove (not shown in the figure) being approached from the second concave portion 133'. Concave portions on the pair of doors 1 and 1' are disposed opposite to each other, and have a same length.

In this embodiment, the concave portion 133 and the handle groove 132 extend only along a part of the length of the door 1. As a result, there is an interval from a top surface 102 and a bottom surface (not shown in the figure) of the door 1.

The user interface 61 is configured to receive information input by a user and/or output information. The user interface 61 includes a user interface electrical module 15. The user interface electrical module 15 may include an output unit configured to output information (for example, setting information of the refrigerator 100 and/or information of food stored in the refrigerator 100, or information irrelevant to the refrigerator such as a video/photo) to a user, and/or an input unit configured to receive a user's instruction. The user interface electrical module may include a display apparatus.

The user interface 6 includes a plurality of touch areas 14*a* indicated by a touch identifier, and a display area 14*b*. The touch areas 14*a* and the display area 14*b* are formed on a front panel 14 in front of the user interface electrical module 5. The front panel 14 is of a one-piece structure.

The touch areas 14*a* may be separated from the display area 14*b* as shown in FIG. 2. In an alternative embodiment, the touch area 14*a* is located within the display area 14*b*.

The user interface electrical module 15 includes a light source. When the light source is turned on, the light can penetrate through the display area 14*b*. The display area 14*b* may also transmit light when the light source is turned off. In another embodiment, when the light source is turned off, light cannot penetrate through the display area 14*b*. In this case, when the light source is turned off, the front panel 14 may be configured so that there is no visible limit between the display area 14*b* and other parts of the front panel 14.

Viewed from a front surface of the door 1, the front surface of the door 1 has a boundary frame 63. The boundary frame 63 is connected to a side of the door 1. In this embodiment, the boundary frame 63 is connected to a right side surface 102 of the door 1 and open at a right side of the door 1.

Viewed from the front surface of the door 1, the operation center 6 is located within the boundary frame 63. That is, viewed from the front surface, the user interface 61 including the user interface electrical module 15, the handle groove 132 and the concave portion 133 are located within the boundary frame 63, namely, the user interface 61, the handle groove 132 and the concave portion 133 do not go beyond the boundary frame 63 in the transverse and longitudinal directions of the door 1, even if the user interface electrical module 15, the handle groove 132 and the concave portion 133 are located at a rear side of the boundary frame 63.

The boundary frame 63 includes a pair of first boundaries 63*a* opposite to each other, and a second edge 63*b* connected between the pair of first boundaries 63*a*. The first boundaries 63*a* extend from a right side surface 103 towards a left side surface 102L by a pre-determined distance. The first boundaries 63*a* are parallel to each other.

In the vertical direction, there is an interval between the boundary frame 63 and the top surface 103 and bottom surface (not shown in the figure) of the door 1. As a result, the operation center 6 keeps a distance away from the top surface 103 and bottom surface of the door 1 separately in the longitudinal direction of the door 1.

The concave portion 133, handle groove 132 and user interface 61 are disposed side by side along a depth direction of the handle groove 132 (namely the transverse direction of the door 1 in this embodiment). Visible elements of the user interface 61 including the touch areas 14*a* and the display area 14*b*, the handle groove 132 and the concave portion 133 are disposed side by side in the transverse direction of the door 1. The user interface electrical module 15 located behind the front panel 14, the handle groove 132 and the concave portion 133 are also disposed side by side in the transverse direction of the door 1.

In such a manner, the touch areas 14*a*, the display area 14*b* and the user interface electrical module 15, the handle groove 132, and the concave portion 133 are disposed side by side in the length direction of the handle groove 132 (also the length direction of the door 1 in this embodiment) and do not overlap, but the three may at least overlap partially along a depth direction of the handle groove 132 (also the transverse direction of the door 1 in this embodiment). Thus, the handle groove 132 and the concave portion 133 may be constructed to have a larger length in the operation center 6 when demanded.

In this embodiment, all the touch areas 14*a* and the display area 14*b* are located between the handle groove 132 and the left side surface 102L of the door 1.

Figure 4:
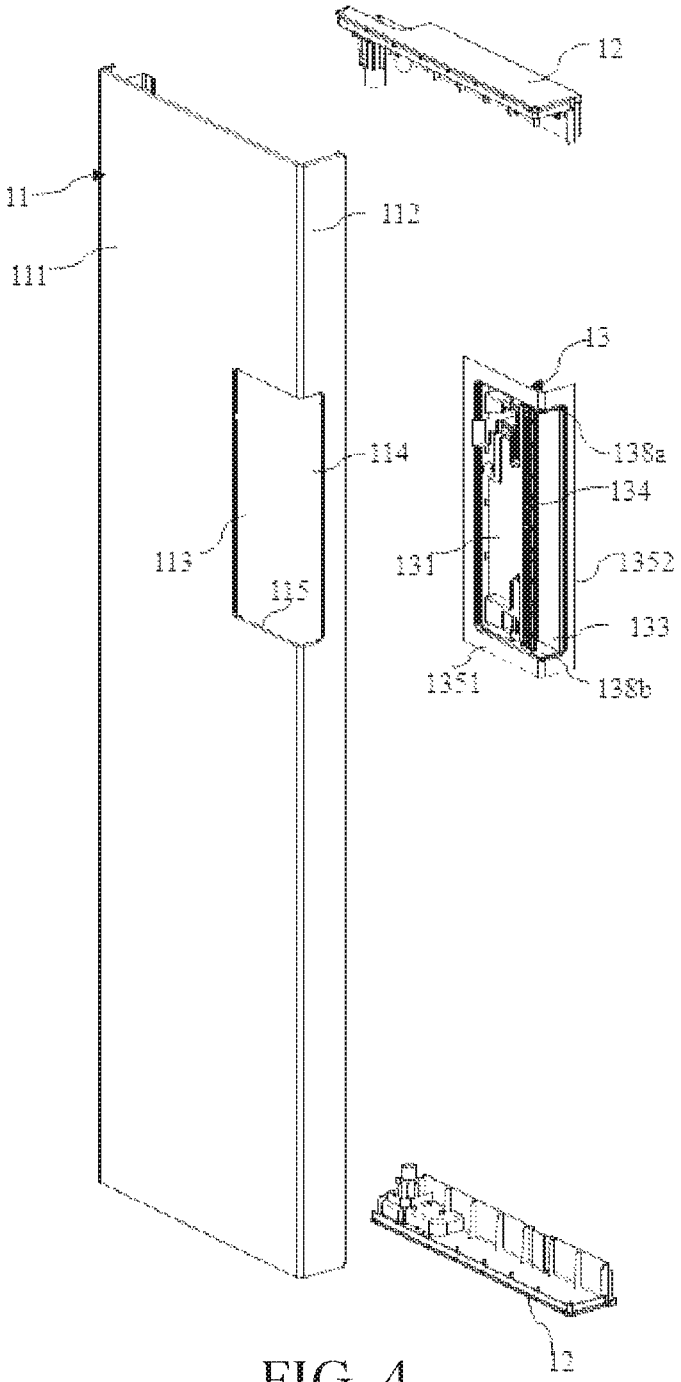
FIG. 4 is a schematic exploded view of a door body shown in FIG. 3.
Figure 5:
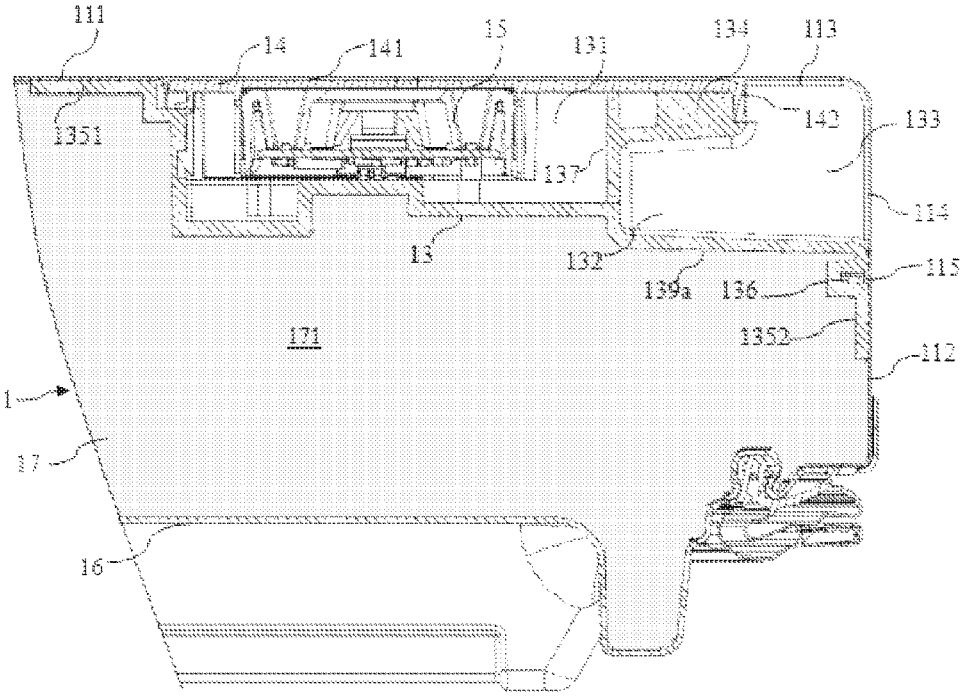
FIG. 5 is a schematic partial sectional view along the A-A direction in FIG. 2.

Referring to FIG. 3 to FIG. 5, the door 1 includes a door body 10. The user interface electrical module 15 may be accommodated in the door body 10. The front panel 14 may be detachably connected to the door body 10, so as to cover the user interface electrical module 15.

The user interface electrical module 15 is connected to a rear surface of the front panel 14, so as to receive an instruction input by a user through touching the front panel 14.

In addition to the user interface electrical module 15, the handle groove 132 is also located behind the front panel 14. That is, in the front-back direction, the handle groove 132 and the user interface electrical module 15 are covered by a single panel, namely the front panel 14.

The grip portion 134 is located between the handle groove 132 and the front panel 14 in the front-back direction. The grip portion 134 forms a front edge of the handle groove 132. When a user puts the hand into the handle groove 132, the grip portion 134 may be grasped by the fingers put by the user into the handle groove 132 so as to open the door 1. Generally, some fingers of a user press a rear surface of the grip portion 134, and another finger (such as a thumb) presses a front panel 14 in front of the grip portion 134, thereby applying a force to open the door 2.

The door body 10 includes a door inner liner 16 (FIG. 5), a piece of sheet metal 11, an upper/a lower end cover 12, a user interface housing 13 and a heat insulation layer 17 located within a thermal insulation space 171. The thermal insulation space 171 is restricted by the door inner liner 16, the piece of sheet metal 11, the upper/lower end cover 12 and the user interface housing 13. These parts are fixed in a non-detachable manner by the heat insulation layer 17 in a foaming process.

The piece of sheet metal 11 includes a front wall 111, and the front wall 111 is located in front of the door inner liner 16 and keeps a pre-determined distance away from the door inner liner 16. In this embodiment, the front wall 11 is exposed at a front surface of the door 1.

The piece of sheet metal 11 includes a pair of side walls 112, and each of the side walls 112 bends from a corresponding side of the front wall 111 and extends backward. The rear end of the side wall 112 is connected to the door inner liner 16. The side wall 112 is at least substantially vertical to the front wall 111.

The front wall 111 has a first opening 113. The first opening 113 is open at a right side of the front wall 111. One of the side walls 112 has a second opening 114. The second opening 114 is open at a front side of the side wall 112. The first opening 113 and the second opening 114 are connected at a connection corner of the front wall 111 and side wall 112.

In the length direction of the door 1, the first opening 113 and the second opening 114 have a same height. In this embodiment, an upper edge of the first opening 113 and that of the second opening 114 are located at a same height. A lower edge of the first opening 113 and that of the second opening 114 are also located at a same height.

In this embodiment, the first opening 113 and the second opening are rectangular, and upper and lower edges thereof are parallel to the top surface 103 of the door 1.

As an integral part of the door body 10, the user interface housing 13 is connected to the piece of sheet metal 11 so as to close the first opening 113 and second opening 114 relative to the thermal insulation space 171 before the foaming process.

In this embodiment, the user interface housing 13 has a first connection projection 1351 with a surface thereof connected to a rear surface of the front wall 111, and a second connection projection 1352 with a surface thereof connected to an inner surface of the side wall 112. The first connection projection 1351 and the second connection projection 1352 are at least substantially vertical to each other.

Shapes of the first connection projection 1351 and the second connection projection 1352 respectively adapt to the first opening 113 and the second opening 114, so that the first connection projection 1351 is attached to a rear side of the front wall 111 along the first opening 113, and the second connection projection 1352 is attached to an inner side of the side wall 112 along the second opening 114.

The piece of sheet metal 11 may include a connection flange 115 that bends backward/inward from the front wall 111 and the side wall 112. The connection flange 115 is disposed along the first opening 113 and the second opening 114. The connection flange 115 is connected to the user interface housing 13. The user interface housing 13 may have an insertion groove 136 that is disposed along the first opening 113 and the second opening 114. The connection flange 115 is inserted into the insertion groove 136.

The user interface housing 13 is substantially box-shaped so as to accommodate the user interface electrical module 15, and dispose the handle groove 132 and concave portion 133 in the user interface housing 13.

The user interface housing 13 includes at least a part of the accommodating space 131 that is used for accommodating the user interface electrical module 15. The accommodating space 131 faces towards the first opening 113, so that the accommodating space 131 can be approached through the first opening 113.

The concave portion 133 is formed by a part of the user interface housing 13 near the side wall 112. The concave portion 133 is open towards the first opening 113 and the second opening 114, so that the concave portion 133 dents backward from the front surface 101 of the door, and dents inward from the right side surface 102 of the door. Thus, the handle groove 132 located within the user interface housing 13 is accessible to a user via the concave portion 133.

In conclusion, the accommodating space 131, handle groove 132 and concave portion 133 are all located within the user interface housing 13. The concave portion 133, handle groove 132 and accommodating space 131 are successively disposed side by side along the depth direction of the handle groove 132. Along a depth direction of the handle groove 132, the handle groove 132 is located between the accommodating space 131 and the concave portion 133.

The length of the concave portion 133 is substantially equal to the length of the first opening 113 and the second opening 114. In this embodiment, the length of the concave portion 133 is slightly less than the length of the first opening 113 and the second opening 114, for the connection flange 115 is located very close to but outside the second opening 114 because a wall of the insertion groove 136 exists between the connection flange 115 and the second opening 114. In an alternative embodiment, when the connection flange 115 is located inside the second opening 114, the length of the concave portion may also be equal to the length of the first opening 113 and the second opening 114.

The length of the handle groove 132 may be equal to the length of the concave portion 133. For example, the both may have continuous end edge walls 138*a* and 138*b*.

Rear boundaries of the handle groove 132 and the concave portion 133 may be restricted by a first rear wall 139*a* of the user interface housing 13. The first rear wall 139*a* has a continuous smooth front surface. A side of the first rear wall 139*a* that faces towards the thermal insulation space 171 may be combined with the heat insulation layer 17.

In this embodiment, a front surface of the first rear wall 139*a* is parallel to the front wall 111. In this embodiment, the handle groove 132 and the concave portion 133 are formed by a corresponding part of an integral groove (not marked) within the user interface housing 13.

The user interface housing 13 has a separation wall 137 that separates the accommodating space 131 from the handle groove 132, so that when a user opens the door, the user may not put the hand into the accommodating space 131. The grip portion 134 is connected to a front end of the separation wall 137.

The grip portion 134 extends along the whole length of the handle groove 132. The grip portion 134 is located behind the front panel 14. The grip portion 134 may be basically parallel to the front panel 14. In this embodiment, the grip portion 134 is integrated into the user interface housing 13 as a whole.

The front panel 14 is connected to the user interface housing 13 and located within the first opening 113. The front panel 14 covers the user interface electrical module 15 and the grip portion 134. The front panel 14 may be manufactured from plastic.

The front panel 14 includes at least a majority part of the front panel portion 141 that covers the user interface electrical module 15 and the grip portion 134 in the thickness direction of the door 1 (namely, the front-back direction). The touch areas 14*a* and the display area 14*b* are disposed on the front panel portion 141. The front panel 14 further includes a side panel portion 142 that bends from a side of the front panel portion 141 and extends backward. Along a depth direction of the handle groove 132, the side panel portion 142 covers at least a part of the grip portion 134. Thus, viewed from a side surface of the door 1, the door 1 may appear simpler. The side panel portion 142 may be vertical to the front panel portion 141.

During a manufacturing process of the door 1, the user interface housing 13, upper/lower end covers 12 and the piece of sheet metal 11 are installed together to form a door tray. The door tray is closed by the door inner liner 16 in a foaming process.

After the foaming process of the door 1 is performed, the user interface housing 13, upper/lower end covers 12, the piece of sheet metal 11 and a side of the door inner liner 16 that faces towards the thermal insulation space 171 are in contact with the heat insulation layer 17, and integrated with the heat insulation layer 17 in a non-detachable manner.

After completion of the foaming process, the user interface electrical module 15 is put into the accommodating space 131. The front panel 14 is fixed to the door body 10, so as to close the accommodating space 131 and cover the grip portion 134. The user interface electrical module 15 may be pre-assembled at the rear of the front panel 14, and then installed together onto the door body 10.

The boundary frame 63 enclosing the touch areas 14*a* and display area 14*b* is restricted by an edge of the first opening 113. Specifically, a first edge 63*a* and a second edge 63*b* of the boundary frame 63 is formed by a connection gap between an edge of the front wall 111 at the first opening 113 and the user interface housing 13 or the front panel 14. As a result, viewed from a front surface of the door 1, the concave portion 133, the handle groove 132 and the user interface module assembly 15 are located within the first opening 113 in the transverse and longitudinal directions of the door 1, that is, the concave portion 133, the handle groove 132 and the user interface module assembly 15 (and the accommodating space 131 that accommodates the user interface electrical module 15) do not go beyond the first opening 113 in the transverse and longitudinal directions of the door 1.

The following describes a second preferred embodiment of the present invention with reference to FIG. 6 to FIG. 9.

Figure 6:
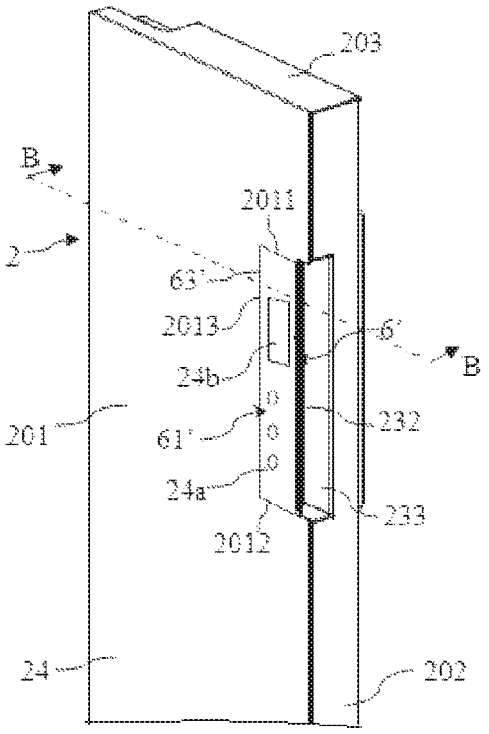
FIG. 6 is a schematic three-dimensional view of a part of a door according to another preferred embodiment of the present invention.

As shown in FIG. 6, similar to the first embodiment, a door 2 used in a refrigerator has an operation center 6'. The operation center 6' includes a user interface 61', as well as a handle groove 232 and a concave portion 233 that are integrated in the operation center 6'. The user interface 61', handle groove 232 and concave portion 233 are disposed side by side along a depth direction of the handle groove 232 (the transverse direction of the door 1).

The operation center 6' has a plurality of touch areas 24*a* and a display area 24*b*. The touch areas 24*a* may be located in the display area 24*b*. In an embodiment, the user interface 61' may be operated by means of touching any place on the display area 24*b*.

Figure 7:
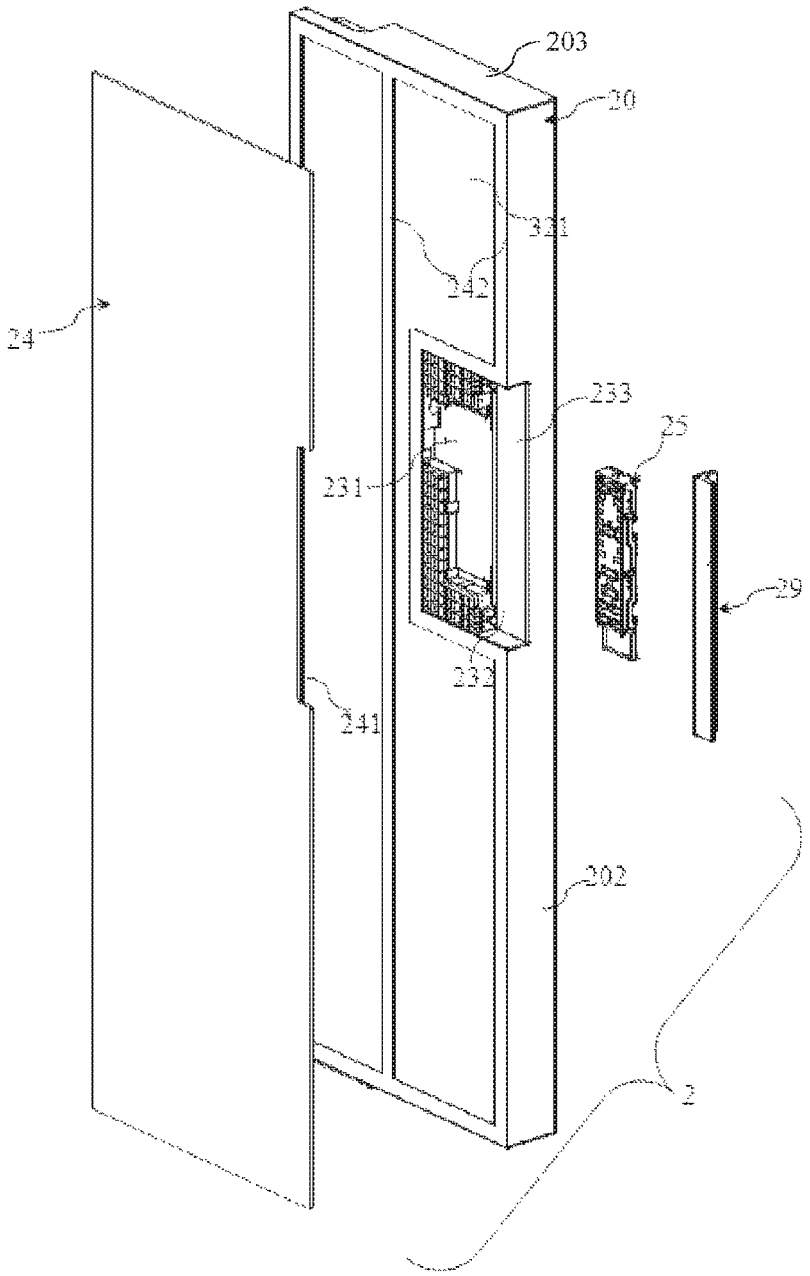
FIG. 7 is a schematic exploded view of a part of the door shown in FIG. 6.

Referring to FIG. 6 and FIG. 7, the door 2 includes a door body 20 having a heat insulation layer 27, and a front panel 24 connected to the door body 20.

Different from the first embodiment, the front panel 24 is not only disposed outside the user interface 61', but also covers other parts of the door body 20. The front panel 24 forms at least a majority part of a front surface of the door 2. The touch areas 24*a* and the display area 24*b* are located on the front panel 24.

The front panel 24 may be manufactured from glass or a material similar to glass. The front panel 24 may be adhered to the door body 20 by using an adhesion apparatus 242. The adhesion apparatus 242 may be, for example, an adhesive tape or glue.

At a rear side of the front panel 24, the door body 20 has an accommodating space 231 for accommodating the user interface electrical module 25. The user interface electrical module 25 is connected to the rear side of the front panel 24, so as to receive an instruction input by a user through touching the front panel 24.

The accommodating space 231 has an entrance that is open towards the handle groove 231. The entrance may be closed by a handle member 29 that is detachably connected to the door body 20. After the front panel 24 is fixed to the door body 20, and before the handle member 29 is fixed to the door body 20 or after the handle member 29 is removed from the door body 20, the user interface electrical module 25 may be inserted into or removed from the accommodating space 231 through the concave portion 233 and the handle groove 232. The handle groove 232 is located between the concave portion 233 and the accommodating space 231.

The front panel 24 has an edge opening 241 at a side corresponding to the user interface 61'. The edge opening 241 is located right ahead of the concave portion 233 so as to expose the concave portion 233. The edge opening 241 may have a shape that adapts to the concave portion 233. Thus, the concave portion 233 is exposed at a front side of the door 2, and may be approached from the front side of the door 2. In this embodiment, the concave portion 233 is also exposed at a right side of the door 2, and may be approached from the right side of the door 2.

The handle member 29 is connected to the door body 20 through the concave portion 233. The handle member 29 includes a grip portion 291. When a user puts the hand into the handle groove 232, the grip portion 291 may be grasped by the user with fingers thereof. In the front-back direction, the handle member 29 may be entirely covered by the front panel 24, and the grip portion 291 is located between the handle groove 232 and the front panel 24. When the door is opened, some fingers of a user press a rear surface of the grip portion 291, and another finger (such as a thumb) may press a front panel 24 in front of the grip portion 291, thereby applying a force to open the door 2.

The front panel 24 has a printed indication frame 63' (only shown in FIG. 6). The indication frame 63' includes a pair of first boundaries 2011 and 2012. A first end of each of the first boundaries 2011 and 2022 is connected to an upper edge or a lower edge of the edge opening 241, and extends towards a left side of the front panel 24 by a pre-determined length. The indication frame 63' includes a second edge 2013 that is connected to the pair of first boundaries 2011 and 2012. The second edge 2013 is connected to a second end (namely, an end far away from the edge opening 241) of the first boundaries 2011 and 2012, and separated from the edge opening 241.

Visible elements of the user interface 61' (including the touch areas 24*a* and the display area 24*b*) are located within the indication frame 63' in the transverse and longitudinal directions of the door 2.

The indication frame 63' together with an upper edge and a lower edge of the edge opening 241 forms a boundary frame. The boundary frame is connected to a right side surface 202 of the door 2 and open at the right side surface 202 of the door 2. That is, the boundary frame is not a closed loop, but is open at the right side surface 202 of the door 2. In the transverse and longitudinal directions of the door 2, the user interface 61', handle groove 232 and concave portion 233 are located within the boundary frame, that is, the user interface 61', handle groove 232 and concave portion 233 do not go beyond the boundary frame in the transverse and longitudinal directions of the door 2. In the front-back direction, a part of the user interface 61', the handle groove 232, and the concave portion 233 are located behind the boundary frame of the door 2.

Figure 9:
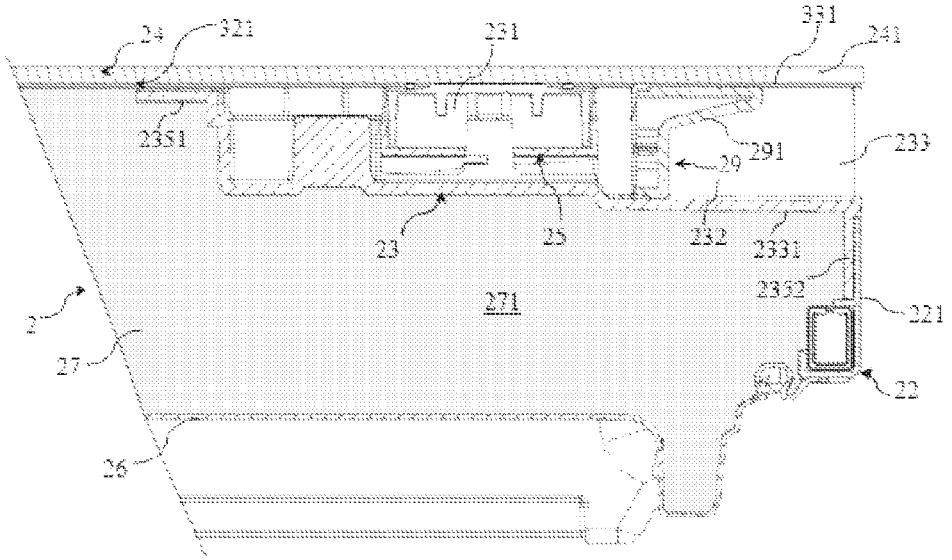
FIG. 9 is a partial sectional view along the B-B direction in FIG. 6.
Figure 8:
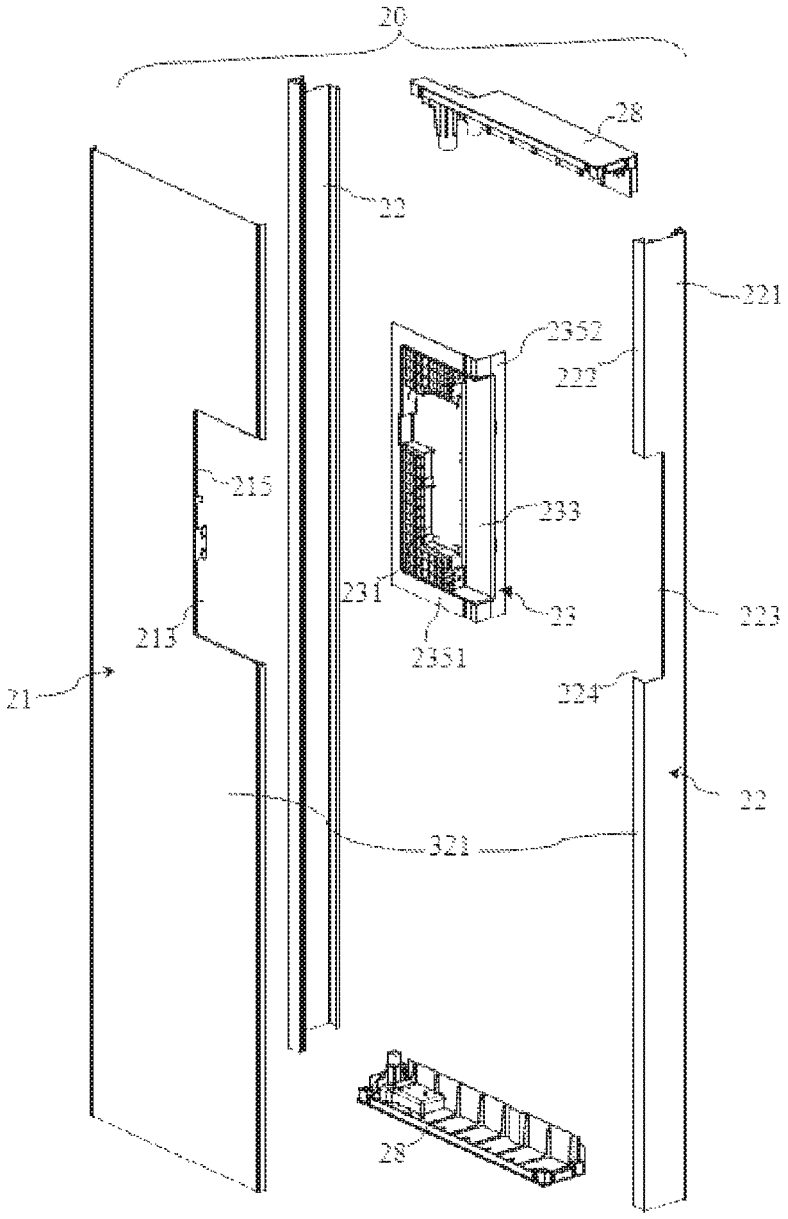
FIG. 8 is a schematic exploded view of a door body shown in FIG. 7.

Refer to FIG. 7, FIG. 8 and FIG. 9. The door body 20 includes a piece of sheet metal 21, a pair of door borders 22 that are connected to the piece of sheet metal 21 and correspond to a longitudinal side, upper and lower handle members 28 that are respectively connected to the upper and lower end of the piece of sheet metal 21, and a user interface housing 23 that is connected to the piece of sheet metal 21 and a corresponding door border 22. The heat insulation layer 27 is filled in a heat insulation space 271 closed by the piece of sheet metal 21, door borders 22, end handle members 28, and door inner liner 26. The piece of sheet metal 21, door borders 22, end handle members 28, user interface housing 23, and door inner liner 26 are fixed together in a non-detachable manner through the heat insulation layer 27.

In this embodiment, each door border 22 has a side wall 221 that forms most part thereof, and a front strip 222 that is connected to a front end of the side wall 221 and extends inward.

The piece of sheet metal 21 is connected to the door borders 22, so that the front strip 222 and the piece of sheet metal 21 together form a front wall 321 located in front of the door inner liner 26 of the door body 20. Each front strip 222 is located at a corresponding side of the piece of sheet metal 21.

The front wall 321 has a first opening 331 (shown in FIG. 9), and the first opening 331 is formed by a first opening portion 213 located on the piece of sheet metal 21 and a second opening portion 224 located on the right door border 22.

The side wall 221 has a second opening 223. The first opening 331 and the second opening 223 are connected at a connection corner of the front wall 321 and the side wall 221.

The user interface housing 23 is connected to the front wall 321 and the side wall 221, and closes the first opening 331 and the second opening 223 relative to the thermal insulation space 271, that is, the thermal insulation space 271 may be closed at the first opening 331 and the second opening 223 due to the user interface housing 23.

Similar to the first embodiment, the user interface housing 23 is substantially box-shaped so as to accommodate the user interface electrical module 25, and dispose the handle groove 232 and concave portion 133 in the user interface housing 23.

Similar to the first embodiment, the user interface housing 23 has a first connection projection 2351 connected to a rear surface of the front wall 321, and a second connection projection 2352 connected to an inner surface of the side wall 221. The piece of sheet metal 21 may have a connection flange 215 that is disposed along the first opening portion 211, and is plugged into the user interface housing 23.

The user interface housing 23 includes at least a part of the accommodating space 231 that is used for accommodating the user interface electrical module 25. The accommodating space 231 is open towards the first opening 331, so that the accommodating space 231 can be approached through the first opening 331.

The concave portion 233 is formed by a part of the user interface housing 23 near the side wall 221. The concave portion 233 is open towards the first opening 331 and the second opening 223, and exposed at a front surface 201 and a right side surface 202 of the door. Thus, the handle groove 232 located within the user interface housing 23 is accessible to a user via the concave portion 233.

As shown in FIG. 9, the handle groove 232, concave portion 233 and accommodating space 231 may be located at different depths in the thickness direction of the door 2. A rear edge of the handle groove 232 and concave portion 233 may be restricted by a continuous smooth rear wall 2331. The rear wall 2331 is integrated into the user interface housing 23 as a whole, and combined with the heat insulation layer 27.

The length of the concave portion 233 may be equal to or slightly less than the length of the first opening 331. In an embodiment, the length of the concave portion 233 may be accurately equal to the length of the first opening 331 by means of properly arranging the front wall 321 and user interface housing 23. For example, the front wall 321 has an end edge that extends into the user interface housing 23 and forms a concave portion. Alternatively, in another embodiment, the length of the concave portion may be slightly less than the length of the first opening 331. For example, a wall with an end edge that is used to form a concave portion in the user interface housing 23 is located inside the first opening 331 and close to an edge of the first opening 331.

In conclusion, the accommodating space 231, handle groove 232 and concave portion 233 are all located within the user interface housing 23. The concave portion 233, handle groove 232 and accommodating space 231 are successively disposed side by side along the depth direction of the handle groove 232. Along a depth direction of the handle groove 232, the handle groove 232 is located between the accommodating space 231 and the concave portion 233.

Figure 10:
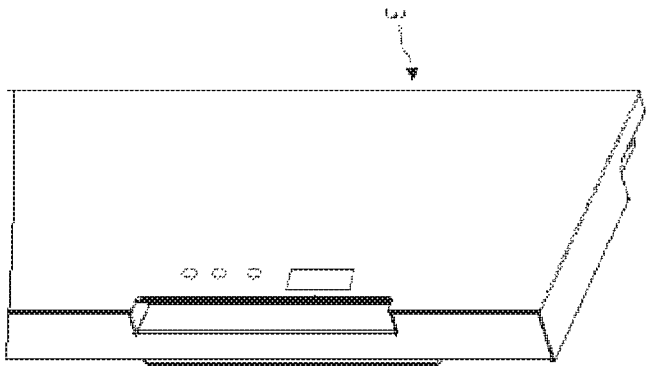
FIG. 10 is a schematic three-dimensional view of a part of a door according to a further preferred embodiment of the present invention.

FIG. 10 is a schematic three-dimensional view of a door 3 according to a third preferred embodiment of the present invention. The door 3 in this embodiment is different from the door 2 in the second embodiment only in that the front panel 24 has not an indication frame 63'. All other aspects thereof may be the same as the door 2, and therefore, the details are not described herein again.

The embodiments of single components described with reference to FIG. 1 to FIG. 9 may be combined with each other in any giver manner, so as to achieve advantages of the present invention. In addition, the present invention is not limited to the shown embodiments, and generally, a means other than the shown means may also be used as long as a same effect can also be achieved by these means.

What is claimed is:

1. A refrigerator, comprising a door, said door including:
- a front surface, a side surface, a transverse direction and a longitudinal direction of said door;
- an accommodating space;
- a user interface electrical module being accommodated in said accommodating space;
- a concave portion being open towards said front surface and said side surface of said door;
- a handle groove being accessible to a user though said concave portion, said handle groove having a depth direction;
- a visible boundary frame being connected to and open at said side surface of said door;
- said user interface electrical module, said handle groove and said concave portion being located within said visible boundary frame in said transverse and longitudinal directions of said door; and
- said concave portion, said handle groove and said user interface electrical module being successively disposed side by side along said depth direction of said handle groove.

2. The refrigerator according to claim 1, wherein:
- said boundary frame includes a pair of first boundaries disposed opposite and parallel to each other and a second boundary interconnecting said pair of first boundaries;
- said first boundaries being connected to said side surface of said door; and
- said second boundary being disposed at a distance from said side surface, of said door.

3. The refrigerator according to claim 2, wherein said first boundaries extend horizontally or vertically on said door.

4. The refrigerator according to claim 1, wherein said concave portion has a length being equal to or less than a length of said boundary frame.

5. The refrigerator according to claim 1, wherein:
- said door includes a door body;
- said door body includes an inner door liner, a user interface housing, and a front wall being disposed in front of said inner door liner and having a first opening;
- a thermal insulation space disposed between said inner door liner and said front wall;
- said user interface housing closing said first opening relative to said thermal insulation space; and
- said accommodating space, said handle groove and said concave portion being disposed within said user interface housing.

6. The refrigerator according to claim 5, wherein said boundary frame is substantially defined by said first opening.

7. The refrigerator according to claim 5, wherein:
- said door body includes a side wall having a second opening in communication with said first opening;
- said user interface housing is connected to said front wall and said side wall; and
- said second opening is closed by said user interface housing relative to said thermal insulation space.

8. The refrigerator according to claim 5, wherein said door includes a front panel covering said user interface electrical module, and said handle groove is disposed behind said front panel.

9. The refrigerator according to claim 8, which further comprises a grip portion disposed between said front panel and said handle groove in a front-back direction of said door.

10. The refrigerator according to claim 8, wherein said front panel forms at least a majority of said front surface of said door, and said front panel has an edge with an edge opening exposing said concave portion in a forward direction of said door.

11. The refrigerator according to claim 8, wherein said front panel is detachably fixed to said user interface housing.

12. The refrigerator according to claim 8, which further comprises a handle member being detachably connected to said door, said accommodating space having an entrance being open towards a side of said handle groove, and said entrance being closed by said handle member.

13. The refrigerator according to claim 5, wherein said concave portion has a length being equal to or less than a length of said first opening.

14. The refrigerator according to claim 9, wherein:

said front panel includes a front panel portion covering said user interface electrical module and said grip portion in said front-back direction of said door, said front panel portion has a side;

said front panel includes a side panel portion connected to said side of said front panel portion and extending backward; and said side panel portion covers at least a part of said grip portion along said depth direction of said handle groove.

15. The refrigerator according to claim 5, wherein said user interface housing includes a rear wall, said rear wall defining a rear edge of said handle groove and said concave portion.

* * * * *